United States Patent [19]

Brackenbush et al.

[11] 4,251,123

[45] Feb. 17, 1981

[54] GLOVE BOX SHIELD

[75] Inventors: Larry W. Brackenbush; Glenn R. Hoenes, both of Richland, Wash.

[73] Assignee: The United States of America as represented by the United States Department of Energy, Washington, D.C.

[21] Appl. No.: 36,257

[22] Filed: May 4, 1979

[51] Int. Cl.[3] ..... A61G 11/00; G06D 17/00

[52] U.S. Cl. ..... 312/1; 160/180

[58] Field of Search ..... 312/1; 220/224, 84; 160/180; 128/1 B; 52/398

[56] References Cited

U.S. PATENT DOCUMENTS

| | | | |
|---|---|---|---|
| 2,803,370 | 8/1957 | Lennard | 312/1 |
| 3,826,300 | 7/1974 | Lee | 312/1 |
| 4,089,571 | 5/1978 | Landy | 312/1 |
| 4,162,967 | 7/1979 | Folsom et al. | 312/1 |

*Primary Examiner*—Casmir A. Nunberg

*Attorney, Agent, or Firm*—Frank H. Jackson; Richard G. Besha

[57] ABSTRACT

According to the present invention, a shield for a glove box housing radioactive material is comprised of spaced apart clamping members which maintain three overlapping flaps in place therebetween. There is a central flap and two side flaps, the side flaps overlapping at the interior edges thereof and the central flap extending past the intersection of the side flaps in order to insure that the shield is always closed when the user withdraws his hand from the glove box. Lead loaded neoprene rubber is the preferred material for the three flaps, the extent of lead loading depending upon the radiation levels within the glove box.

17 Claims, 2 Drawing Figures

FIG 1
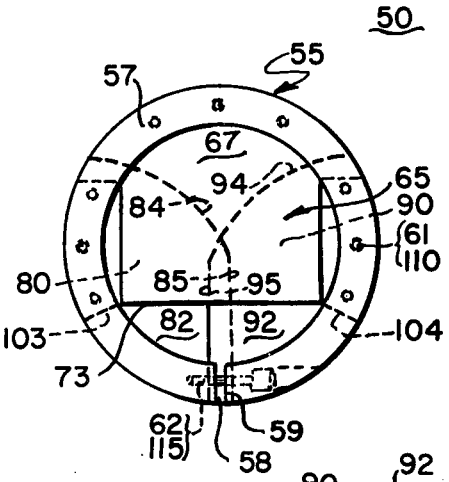
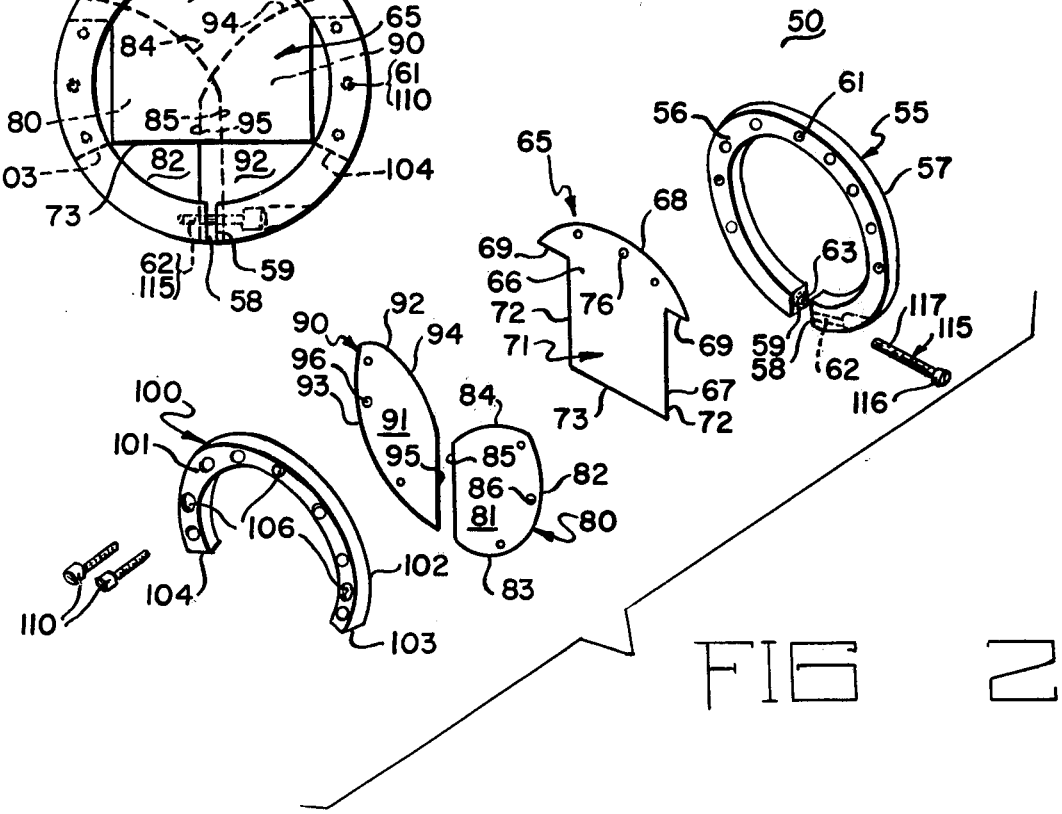
FIG 2

GLOVE BOX SHIELD

CONTRACTUAL ORIGIN OF THE INVENTION

The invention described herein was made in the course of, or under, a contract with the UNITED STATES DEPARTMENT OF ENERGY.

BACKGROUND OF THE INVENTION

This invention relates to a shield for a glove box having radioactive material therein. In more detail, the invention relates to a sandwich arrangement of several flaps which allows easy ingress into the glove box and egress out of the glove box while at the same time providing a substantial barrier to radioactivity.

Considerable plutonium handling is done within glove boxes in order to protect the handler. Most radioactive doses from processing plutonium in glove boxes is the result of low energy photons streaming at the glove box portholes. These photons are mostly 13–21 keV L x-rays from plutonium and 60 keV gamma rays from americium 241. The glove box porthole should be closed with a radiation absorbent or impervious material when the glove box is not in use in order to reduce the radiation dose delivered to workers and attending personnel. One method available in the prior art is to provide cover plates which frictionally fit over the glove box porthole. The problem with these cover plates is that the workers must remove these plates to obtain access to the glove box interior and then leave them off because they interfere with the work process. Seldom are these plates replaced when the workers are finished with the glove box, thereby leaving open portholes with the attendant radiation streaming.

Ideally, a glove box porthole shield will allow easy ingress and egress for the worker while at the same time providing a substantially impervious shield to the particular radiation present in the glove box. The shield must be altered to accommodate various energy level radiation.

Representative prior art in the field is disclosed in the Landy U.S. Pat. No. 4,089,571 issued May 16, 1978 which discloses a glove box port and insert therefor which is contained within a glove having a sleeve connected to the periphery of the glove box port. The Landy device does not overcome the problem previously discussed since the operator still has to replace the insert after he is finished working within the glove box, and if he forgets to replace the insert, radioactive streaming will expose the attendant personnel to radiation hazard. The Dickson et al. U.S. Pat. No. 2,708,927 issued May 24, 1955 discloses an incubator for infants having a circular port resiliently flexible diaphragm closures within the port. A device of this type was tried as a radiation shield but was found to be unsatisfactory since the individual parts of the diaphragm often did not completely close, thereby permitting substantial radiation streaming to occur. The Lennard U.S. Pat. No. 2,803,370 issued August 20, 1957 discloses yet another closure device for housings using a protective atmosphere. The Lennard patent discloses a sandwich of rubber disks each having radial slits therein which intersect at the points spaced from the center of the disks. Abutting disks have intersection points removed from one another to insure complete closure.

SUMMARY OF THE INVENTION

According to the present invention, a shield for a glove box housing radioactive material is comprised of spaced apart clamping members which maintain three overlapping flaps in place therebetween. There is a central flap and two side flaps, the side flaps overlapping at the interior edges thereof and the central flap extending past the intersection of the side flaps in order to insure that the shield is always closed when the user withdraws his hand from the glove box. Lead loaded neoprene rubber is the preferred material for the three flaps, the extent of lead loading depending upon the radiation levels within the glove box.

Accordingly, it is a principal object of the present invention to provide a shield for an opening in a container housing radioactive material to prevent radiation streaming therefrom which allows easy access to the container interior and provides effective and automatic shielding during egress from the container.

An important object of the present invention is to provide a shield for an opening in a container housing radioactive material comprising two spaced-apart clamping members, at least one of the members having dimensions larger than the opening, two flexible side flaps oppositely disposed between the clamping members having the free edges thereof overlapping, a center flap between the clamping members having a free edge thereof extending past the intersection of the side flap free edges, the side flap and center flap being substantially impervious to radiation from the radioactive material, and means for maintaining the clamping members together and in position over the container opening.

Still another object of the present invention is to provide a shield of the type set forth in which the center flap is positioned adjacent the clamping member in contact with the container housing.

Yet another object of the present invention is to provide a shield of the type set forth in which the clamping members are part circular.

These and other features of the present invention will be more readily understood by reference to the accompanying specification taken in conjunction with the drawings, in which:

DESCRIPTION OF THE FIGURES

FIG. 1 is a rear elevational view of the glove box shield of the present invention; and FIG. 2 is an exploded perspective view of the shield illustrated in FIG. 1.

DETAILED DESCRIPTION OF THE INVENTION

Referring now to the drawings, there is illustrated a shield 50 for use with the glove porthole in a glove box (not shown). The shield 50 is comprised of an inner clamping member 55, annular in shape, having a front surface 56 and a rear surface 57. The clamping member 55 is in the form of an interrupted ring having opposing end surfaces 58 and 59. The arcuate extent of the ring from end surface 58 to end surface 59 is about 350°. There is an aperture 62 extending perpendicularly to the end surface 58 and a mating aperture 63 in the end surface 59, all for a purpose hereinafter set forth. Finally, there are a plurality of spaced-apart apertures 61 for clamping member 55 to member 100. Nine such apertures 61 are shown; three at the top and three in each side. The diameter of the clamping member 55 is designed to fit around a lip on the glove box porthole and may be varied according to the size of the aperture available.

Adjacent the inner clamping member 55 is a center flap 65 having a front surface 66 and a rear surface 67. The top of the center flap 65 is defined by the arcuate peripheral edge 68 which terminates at two inwardly extending straight edges 69. A rectangular portion 71 extends downwardly from the innermost ends of the edges 69 and is defined by spaced-apart parallel side edges 72 and an interconnecting bottom edge 73. Three apertures 76 are provided along the arcuate edges 68 slightly below the edge to coincide with the three apertures 61 at the top of the inner clamping member 55.

Two spaced-apart side flaps 80 and 90 are provided with the side flap 80 having a front surface 81 and a rear surface 82. An arcuate side edge 83 joins an arcuate top edge 84 with a straight inner edge 85, positioned vertically in use. Three apertures 86 are positioned adjacent the side edge 83 to coincide with the three apertures 61 on one side of clamping member 55. Similarly, the side flap 90 which is identical in shape to the side flap 80 has opposed front and rear surfaces 91 and 92. An arcuate side edge 93 joins an arcuate top edge 94 which, like the edge 84, joins a straight inner edge 95, disposed vertically in use and parallel to edge 85. Three apertures 96 are provided in the side flap 90 to coincide with the three apertures 61 in the other side of clamping member 55.

An outer clamping member 100 is part-circular in shape and has an arcuate extent of approximately 240°. The outer clamping member has opposed front and rear surfaces 101 and 102, respectively, with the ends of the member 100 being designated respectively 103 and 104. Nine spaced-apart apertures 106 are angularly spaced along the member 100 and extend therethrough from the front surface 101 through the rear surface 102. The apertures 106 are angularly spaced to align with respective ones of the apertures 61 in the inner clamping member 55 and also to align with respective ones of the apertures 76 in the center flap 65 and the apertures 86 and 96 in the side flaps 80 and 90, respectively. Nine threaded fasteners 110 each adapted to fit through respective ones of the previously mentioned aligned apertures in the inner clamping member 55, the center flap 65, the side flaps 80 and 90, and the outer clamping member 100 are provided to maintain the constituent parts of the shield 50 in precise relation to each other and to the associated glove box. It will be appreciated that the precise arrangement of fasteners shown is not critical as all that is necessary is that the parts of the shield be held together firmly and that the shield be firmly anchored to the glove box. The fastener 115, having an enlarged end 116 and a threaded end 117, is adapted to fit within the apertures 62 and 63 and to adjust the distance between the ends 58 and 59 of the inner clamping member 55, thereby to provide an adjustable tensioning mechanism with the inner clamping member 55 when it is placed around the lip of the associated glove box porthole.

For most effecient operation, the parts of the shield 50 of the present invention should be arranged as disclosed in FIG. 2 with the center flap 65 being adjacent the inner clamping member 55 and the side flaps 80 and 90 overlapping as illustrated and clamped in place by the coaction between the outer clamping member 100, the inner clamping member 55 and the fastening means 110. Specifically, the inner edges 85 and 95 of the side flaps 80 and 90, respectively, overlap approximately 1 inch, as illustrated in FIG. 1, and the bottom horizontal edge 73 of the center flap 65 extends well below the intersection of the side flaps 80 and 90, thereby to insure complete and automatic closure of the glove box porthole upon withdrawal from the glove box by the worker. The construction of the present invention allows easy ingress and egress with respect to the material in the glove box without binding the worker's arm or hand, while at the same time insuring that upon egress from the glove box porthole the opening will be completely sealed to prevent any radiation streaming. By placing the center flap 65 adjacent the inner clamping member 55 which is mounted to the lip of the glove box porthole, the porthole remains sealed and the shield remains intact upon withdrawal of the worker's arm, whereas interchanging the positions of the center flap 65 and the side flaps 80 and 90 may result in the porthole remaining open because the center flap 65 may be pushed through the two side flaps 80 and 90 upon ingress to the glove box, but not be pulled back during egress. Placement of the parts as shown in the drawings insures that mispositioning of the center flap 65 and the side flaps 80 and 90 does not occur.

Preferred materials of construction for the center flap 65 and the two side flaps 80 and 90 are 1/16 inch thick lead loaded neoprene rubber, the extent of the lead-loading depending on the energy level of the radiation present within the glove box. Commercially available lead loaded neoprene rubber was used in constructional examples, and neoprene rubber with various levels of lead-loading is readily available. The inner clamping member 55 and the outer clamping member 100 is constructed of 1 inch thick polyethylene and a suitable synthetic organic resin such as polyethylene, polypropylene or other suitable resin is preferred to metal, since metal clamping members may have sharp edges which could cut the center flap 65 and the side flaps 80 and 90.

Shields constructed in accordance with the present invention have been used on glove boxes with radiations consisting of 13 to 21 keV L x-rays from plutonium and 60 keV gamma rays from americium 241. Without shields, radiation streaming through the glove box porthole was in the range of from about 30 to about 25 mr per hour and with the shields constructed in accordance with the present invention, radiation streaming was reduced to be in the range of from about 1 to about 7 mr per hour, as measured by C P Survey Meter at 2 inches from the center of the glove port opening. As can be seen therefore, the glove box shield of the present invention is more efficacious to reduce radiation streaming from glove boxes and to accomplish all the objects and advantages of the present invention.

While there has been described what at present are considered to be the preferred embodiment of the present invention it will be understood that various alterations and modifications may be made therein, and it is intended to cover in the appended claims all such alterations and modifications.

The embodiments of the invention in which an exclusive property or privilege is claimed are defined as follows:

1. A shield for an opening in a container housing radioactive material comprising two spaced-apart clamping members, at least one of said members having dimensions larger than the opening, two flexible and resilient side flaps oppositely disposed between said clamping members having the free edges thereof overlapping, a center flap between said clamping members having a free edge thereof extending past the intersection of said side flap free edges, said side flaps and said center flap having a material therein substantially impervious to radiation from the radioactive material, and means for maintaining said clamping members together and in position over the container opening.

2. The shield set forth in claim 1, wherein said clamping members are annular.

3. The shield set forth in claim 1, wherein said clamping member having the dimensions thereof larger than the opening is adapted to fit snugly against the opening and to be maintained in position by said means.

4. The shield set forth in claim 1, wherein said clamping members are a synthetic organic resin.

5. The shield set forth in claim 4, wherein said clamping members are polyethylene.

6. The shield set forth in claim 1, wherein said side flaps are neoprene rubber about 1/16 inch thick having lead dispersed therein.

7. The shield set forth in claim 1, wherein said center flap has three apertures near the top thereof centrally located for mounting between said clamping members, thereby to hang downwardly over said side flaps.

8. A shield for an opening in a container housing radioactive material comprising two spaced-apart clamping members at least one of which is adapted to be mounted on the container, at least one of said members having dimensions larger than the opening, two flexible side flaps oppositely disposed between said clamping members having the free edges thereof overlapping, a center flap between said clamping members having a free edge thereof extending past the intersection of said side flap free edges, said center flap being positioned adjacent said clamping member in contact with the container, said side flaps and said center flap being substantially impervious to radiation from the radioactive material, and means for maintaining said clamping members together and in position over the container opening.

9. The shield set forth in claim 8, wherein said clamping members are annular.

10. The shield set forth in claim 9, wherein said clamping member adapted to be mounted on the container has a circumferential extent of about 350°.

11. The shield set forth in claim 10, wherein said means includes mechanism for varying the distance between the free ends of the 350° clamping members to adjust the tension thereof around the container opening.

12. The shield set forth in claim 10, wherein the other one of said clamping members has an arcuate extent of about 240°.

13. The shield set forth in claim 8, wherein said clamping members are annular in shape and adjustable, thereby permitting alterations in the effective diameters thereof.

14. The shield set forth in claim 8, wherein said center flap and said side flaps are 1/16 inch thick lead loaded neoprene rubber.

15. The shield set forth in claim 8, wherein said clamping members are 1 inch thick polyethylene.

16. A shield for an opening in a container housing radioactive material comprising two spaced-apart arcuate clamping members, at least one of said members having dimensions larger than the opening and at least one of said members having two free ends, two flexible side flaps oppositely disposed between said clamping members having the free edges thereof overlapping, a center flap between said clamping members having a free edge thereof extending past the intersection of said flap free edges, said side flaps and said center flap being substantially impervious to radiation from the radioactive material, means for adjusting the distance between the free ends of the one clamping member to adjust the tension thereof around the container opening, and means for maintaining said clamping members together and in position over the container opening.

17. The shield set forth in claim 16, wherein said member having the free ends is part circular with a circumferential extent of about 350° and is next to the container housing the other member being part circular with a circumferential extent substantially less than 350°.

* * * * *